US006965067B2

(12) United States Patent
Kondo

(10) Patent No.: US 6,965,067 B2
(45) Date of Patent: Nov. 15, 2005

(54) GUITAR TUNER

(75) Inventor: Masaji Kondo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 34 days.

(21) Appl. No.: 10/410,225

(22) Filed: Apr. 9, 2003

(65) Prior Publication Data

US 2004/0020346 A1 Feb. 5, 2004

(30) Foreign Application Priority Data

Apr. 18, 2002 (JP) ..... 2002-116567

(51) Int. Cl.[7] ..... G10G 7/02
(52) U.S. Cl. ..... 84/455; 84/454
(58) Field of Search ..... 84/455, 477 R, 84/601, 602, 603, 604, 605, 606, 453, 454

(56) References Cited

U.S. PATENT DOCUMENTS 5,563,358 A * 10/1996 Zimmerman ..... 84/477 R
5,859,378 A * 1/1999 Freeland et al. ..... 84/454
5,886,270 A * 3/1999 Wynn ..... 84/313
5,959,229 A * 9/1999 Walley ..... 84/454
6,417,435 B2 * 7/2002 Chantzis et al. ..... 84/477 R

* cited by examiner

*Primary Examiner*—Kimberly Lockett
(74) *Attorney, Agent, or Firm*—Adams & Wilks

(57) ABSTRACT

Provided is a guitar tuner that is capable of tuning each string of a guitar with a capotasto being attached thereto to a specified pitch. The guitar tuner includes attachment position setting means for, when the capotasto is attached to the guitar, setting an attachment position of the capotasto to the tuner, and a pitch of each string can be automatically set to a pitch that is specified in the attachment position of the capo.

7 Claims, 4 Drawing Sheets

| FRET | STRING | | | | | |
|---|---|---|---|---|---|---|
| | 6 TH | 5 TH | 4 TH | 3 TH | 2 TH | 1 TH |
| 0 | E2 | A2 | D3 | G3 | B3 | E4 |
| 1 | F2 | A#2 | D#3 | G#3 | C4 | F4 |
| 2 | F#2 | B2 | E3 | A3 | C#4 | F#4 |
| 3 | G2 | C3 | F3 | A#3 | D4 | G4 |
| 4 | G#2 | C#3 | F3# | B3 | D#4 | G#4 |
| 5 | A2 | D3 | G3 | C4 | E4 | A4 |
| 6 | A#2 | D#3 | G#3 | C#4 | F4 | A#4 |
| 7 | B2 | E3 | A3 | D4 | F#4 | B4 |

FIG.2

GUITAR TUNER

BACKGROUND OF THE INVENTION

1. Field of the Invention

The present invention relates to a tuner for tuning a musical instrument such as a guitar.

2. Description of the Related Art

Up to now, there are known guitar tuners that pick up a sound outputted from a musical instrument as a signal by various input means and determine a pitch name and an octave based on the waveform of the obtained signal to display the result. However, the conventional tuners are used only for tuning a pitch of an open string.

When playing a guitar, in order to change a key, a capotasto for pressing all strings down on the same fret at the same time maybe used. The use of the capotasto leads to the following problem. That is, even if each open string has been tuned to a specified pitch without attaching the capo, each corresponding string at the time when the capotasto is attached has different tension and a pitch deviated from the specified pitch. As a result, it is necessary to perform tuning again with the capotasto being attached. At that time, the pitch of each string deviates from that of the corresponding open string depending on a position in which the capotasto is to be attached, so that it is impossible to use the guitar tuner.

SUMMARY OF THE INVENTION

In order to solve the above-mentioned conventional problem, an object of the present invention is to provide attachment position setting means for, when a capotasto is attached to a musical instrument such as a guitar, setting an attachment position of the capotasto to a tuner and means for displaying the attachment position, and to make it possible to automatically set a pitch of each string to a pitch that is specified in the attachment position of the capo.

In order to solve the above problem, according to the present invention, there is provided a guitar tuner including attachment position setting means for, when a capotasto is attached to a guitar, setting an attachment position of the capotasto to the tuner and means for displaying the attachment position, in which a pitch of each string can be automatically set to a pitch that is specified in the attachment position of the capo.

BRIEF DESCRIPTION OF THE DRAWINGS

In the accompanying drawings:

FIG. 2 is a pitch table showing a pitch of each string of a guitar at each fret;

DETAILED DESCRIPTION OF THE PREFERRED EMBODIMENT

Figure 1:
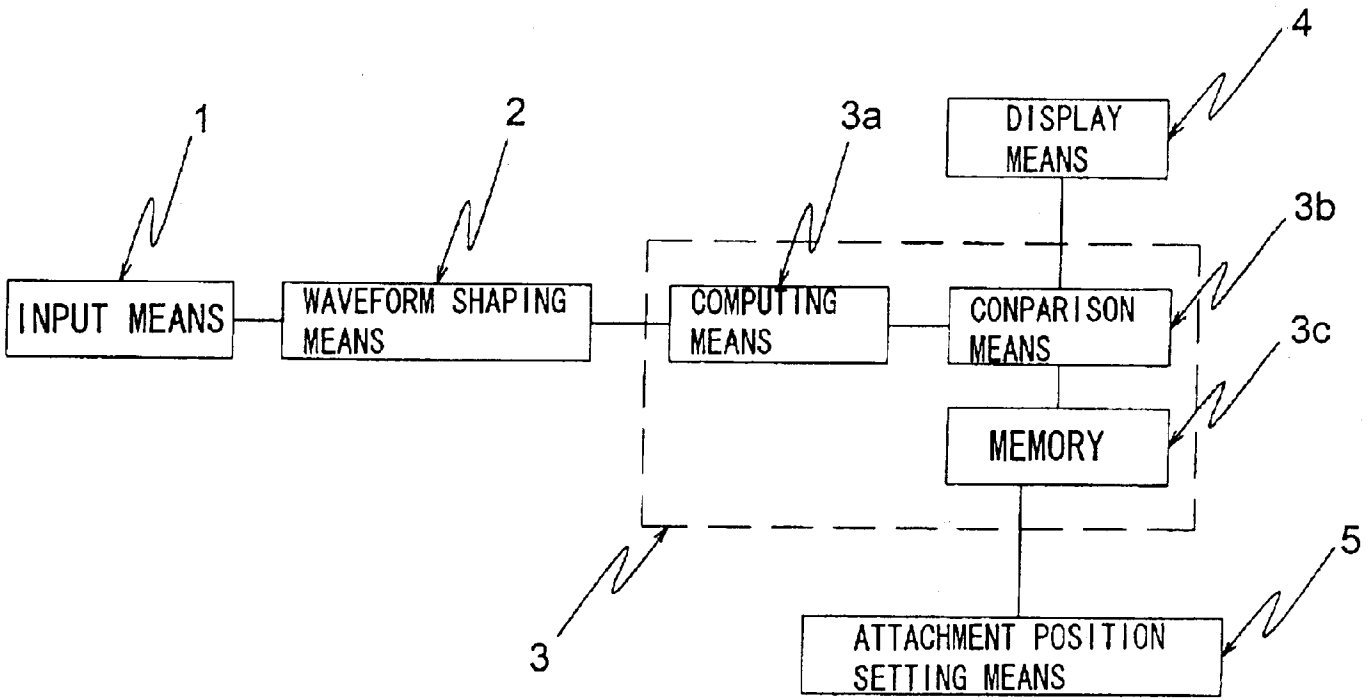
FIG. 1 is a circuit block diagram of a guitar tuner of the present invention.

A description will be made of an embodiment of a tuner for a stringed musical instrument in the form of a guitar tuner according to the present invention with reference to the attached drawings. FIG. 1 is a circuit block diagram showing a structure of the guitar tuner according to the embodiment of the present invention. FIG. 2 is a pitch table showing a pitch of each string of a guitar at each fret. Hereinafter, the description will be made based on FIGS. 1 and 2. First, in a state where a capotasto is attached to the guitar, a sound or vibration outputted from the guitar is inputted to a waveform shaping circuit 2 through input means 1. Examples of the input means 1 include a jack, a microphone, and a sensor. The input means 1 serves to input the sound or vibration outputted from the guitar to the tuner as a vibration signal. The waveform shaping circuit 2 converts the vibration signal of the inputted sound into a pulse shape signal, which is inputted to computing means 3*a* as an output signal from the waveform shaping circuit 2. The waveform shaping circuit 2 is composed of an operational amplifier, a transistor, and the like.

The computing means 3*a* computes a frequency of the sound or vibration outputted from the guitar by measuring a pulse number per unit time of the pulse shape signal inputted from the waveform shaping circuit 2. A frequency corresponding to a pitch name of each string shown in FIG. 2 is stored in a memory 3*c* for each fret. Comparison means 3*b* is used to compare a value computed by the computing means 3*a* with data stored in the memory 3*c* and corresponding to a fret position set by attachment position setting means 5. Based on the compared result, display means 4 performs display.

As one example, a push switch is used as the attachment position setting means 5. Every operation of the switch causes the data stored in the memory 3*c* to be switched to the subsequent data, and causes the fret position thus selected to be displayed by the display means 4.

Alternatively, in another example where a rotary switch is used as the attachment position setting means 5, data stored in the memory 3*c* and corresponding to each position of the rotary switch is switched. At the same time, each position of the rotary switch can also serve to display the fret position.

Figure 3:
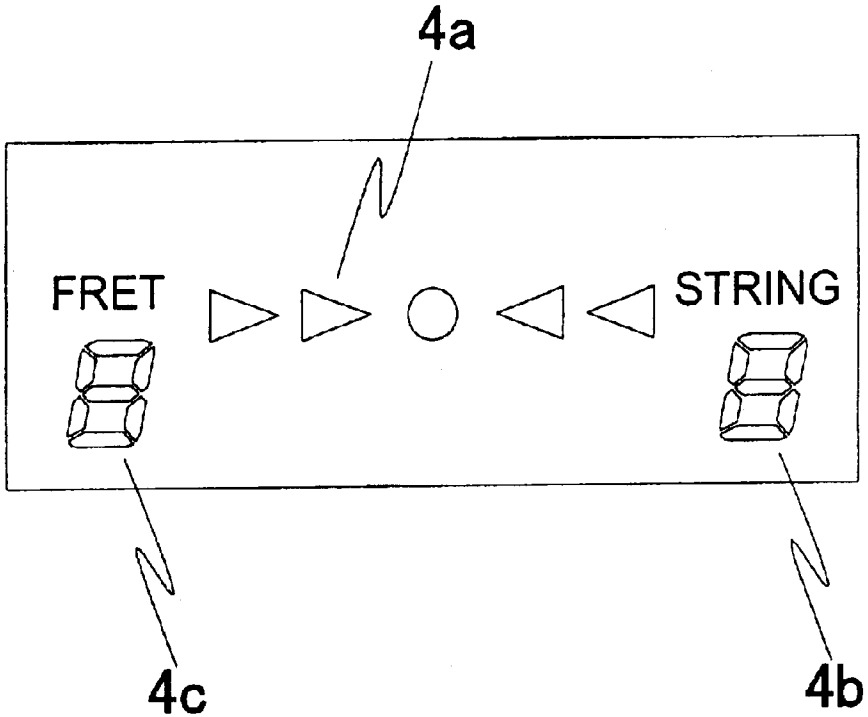
FIG. 3 shows display means of a guitar tuner according to an embodiment of the present invention.

FIG. 3 shows the display means 4 of the guitar tuner according to the embodiment of the present invention. In this embodiment, a string name corresponding to the sound or vibration inputted from the guitar is displayed in a string name display portion 4*b*, and the deviation with respect to a specified frequency is displayed in a deviation display portion 4*a*. In addition, the display means 4 also includes a fret position display portion 4*c* for displaying the fret position set by the attachment position setting means 5. The display means 4 may be set as a display panel and composed of an LED device, a liquid crystal display device, and the like. Generally, a microcomputer 3 is used as the computing means 3*a*, the comparison means 3*b*, and the memory 3*c*.

Figure 4:
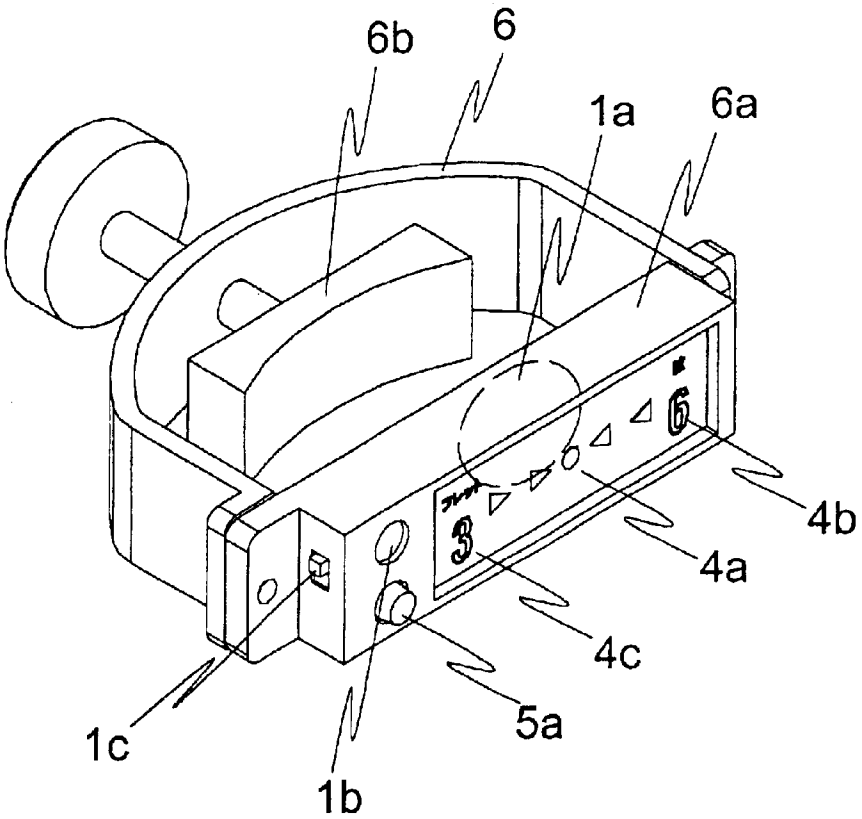
FIG. 4 is a schematic perspective view showing the guitar tuner according to the embodiment of the present invention when the guitar tuner is integrated with a capo, and a vibration sensor and a microphone are selectively used as input means.

FIG. 4 is a schematic perspective view showing the guitar tuner according to the embodiment of the present invention when the guitar tuner is integrated with the capo, and a vibration sensor and a microphone are selectively used as input means 1. The capotasto 6 is composed of a tuner 6*a* that is integrated with a member for pressing each string of the guitar down on the fret, and a member 6*b* for attaching and fixing the tuner 6*a* to the guitar. The tuner 6*a* has the following components built thereinto: a vibration sensor 1*a*, a microphone 1*b*, and an input means selecting switch 1*c*, which serve to input the sound of the guitar; the waveform shaping circuit 2; the microcomputer 3; the display means 4; and an attachment position setting switch 5*a*.

When the capotasto 6 is attached to the guitar, the fret to which the guitar is attached is selected by means of the attachment position setting switch 5*a*, and the vibration sensor 1*a* is selected as the input means 1 by means of the input means selecting switch 1*c* to use the vibration of the string of the guitar as an input. When the capotasto 6 is not attached to the guitar, the attachment position setting switch 5*a* is operated to set the attachment position to "0".

When the attachment position setting switch 5*a* is in the "0" position, the vibration of the string of the guitar cannot be used as the input. Instead, the input means selecting switch 1*c* is used to select the microphone 1*b* as the input means 1, so that the sound of the guitar is used as the input. The description has been made by uniquely using the input means selecting switch 1*c* for selection of the input means 1. However, based on the value set by the attachment position setting switch 5*a*, the input means 1 can be automatically selected by a program of the microcomputer 3.

As described above, the guitar tuner includes attachment position setting means for, when the capotasto is attached to the guitar, setting the attachment position of the capotasto to the tuner, and a pitch of each string can be automatically set to a pitch that is specified in the attachment position of the capo. As a result, each string of the guitar with the capotasto being attached thereto can be tuned to the specified pitch.

What is claimed is:

1. A guitar tuner for tuning each string of a guitar to a specified pitch, comprising:

input means for inputting a vibration of the guitar;

a waveform shaping circuit for converting a waveform of the inputted vibration into a pulse shape signal;

computing means for computing a frequency of the pulse shape signal from the waveform shaping circuit;

a memory in which a specified frequency of each string of the guitar is stored;

comparison means for comparing the computed frequency from the computing means with the specified frequency stored in the memory;

display means for displaying a comparison result from the comparison mean; and attachment position setting means for, when a capotasto is attached to the guitar, setting an attachment position of the capotasto to the guitar tuner to enable a pitch of each string of the guitar to be set to a specified pitch corresponding to the attachment position of the capotasto.

2. A guitar tuner according to claim 1, wherein the guitar tuner is integrated with the capo.

3. A guitar tuner according to claim 2, wherein a vibration sensor and a microphone are selectively used as the input means for inputting the sound of the guitar.

4. A tuner for tuning a musical instrument comprising:

input means for inputting an output vibration of the instrument;

attachment setting means for inputting an attachment position of a capo to the tuner;

waveform shaping means for converting a waveform of the vibration into a pulse shape;

a memory in which a specified frequency of the instrument is stored; and comparison means for comparing a frequency of an output of the waveform shaping means and the specified frequency stored in the memory in accordance with the attachment position.

5. A tuner according to claim 4; further comprising a deviation display portion for displaying information representative of a difference between the frequency of the output of the waveform shaping means and the specified frequency stored in the memory.

6. A tuner according to claim 4; wherein the tuner is integrated with the capo.

7. A tuner according to claim 4; further comprising a sound sensor for inputting a sound of the instrument to the waveform shaping means.

* * * * *